US008977184B2

(12) United States Patent
Tokuda et al.

(10) Patent No.: US 8,977,184 B2
(45) Date of Patent: Mar. 10, 2015

(54) IMAGE FORMING APPARATUS

(71) Applicants: Hiroshi Tokuda, Miyoshi (JP); Tomonori Watanabe, Ichinomiya (JP)

(72) Inventors: Hiroshi Tokuda, Miyoshi (JP); Tomonori Watanabe, Ichinomiya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 13/845,793

(22) Filed: Mar. 18, 2013

(65) Prior Publication Data

US 2014/0003850 A1 Jan. 2, 2014

(30) Foreign Application Priority Data

Jun. 29, 2012 (JP) ..... 2012-147199
Jun. 29, 2012 (JP) ..... 2012-147201

(51) Int. Cl.

| | |
|---|---|
| ***G03G 15/00*** | (2006.01) |
| ***B65H 29/00*** | (2006.01) |
| ***B65H 5/00*** | (2006.01) |
| ***G03G 15/23*** | (2006.01) |
| ***G03G 21/16*** | (2006.01) |

(52) U.S. Cl.

CPC ..... *G03G 15/234* (2013.01); *G03G 21/1604* (2013.01)

USPC ..... 399/364; 399/401; 399/393; 271/184; 271/225

(58) Field of Classification Search

USPC ..... 399/364, 401, 125, 393, 118, 32, 151, 399/152; 271/184, 902, 185, 186, 9.01, 271/225; 355/124; 400/88, 188

See application file for complete search history.

(56) References Cited

U.S. PATENT DOCUMENTS

| | | | | |
|---|---|---|---|---|
| 5,448,348 | A * | 9/1995 | Azeta | 399/364 |
| 2003/0063935 | A1* | 4/2003 | Seo | 399/401 |
| 2006/0291931 | A1* | 12/2006 | Kobayashi | 399/392 |
| 2009/0162122 | A1* | 6/2009 | Roppongi et al. | 399/401 |
| 2012/0119430 | A1* | 5/2012 | Idehara | 271/3.19 |

FOREIGN PATENT DOCUMENTS

| | | | |
|---|---|---|---|
| JP | 2009-031508 | A | 2/2009 |
| JP | 2011-084346 | A | 4/2011 |

* cited by examiner

*Primary Examiner* — Matthew G Marini
(74) *Attorney, Agent, or Firm* — Banner & Witcoff, Ltd.

(57) ABSTRACT

An image forming apparatus includes: a conveyance path configured to guide a recording sheet conveyed from a sheet placement portion, passing through a sheet feeder unit, a nip portion between a photoconductor and transfer member, a fixing device, and a sheet ejection unit in this order; and a re-conveyance path configured to guide the sheet conveyed from the fixing device to an upstream-side path which constitutes part of the conveyance path extending upstream from the photoconductor. The re-conveyance path branches off from the conveyance path at a position downstream from the fixing device and extends to pass through a space between the photoconductor and the exposure device. The re-conveyance path includes a switchback mechanism configured to reverse a traveling direction of a sheet conveyed along the re-conveyance path after passing through the space between the photoconductor and the exposure device and to convey the sheet toward the upstream-side path.

23 Claims, 5 Drawing Sheets

IMAGE FORMING APPARATUS

CROSS-REFERENCE TO RELATED APPLICATION(S)

This application claims priority from Japanese Patent Applications Nos. 2012-147199 filed on Jun. 29, 2012 and 2012-147201 filed on Jun. 29, 2012, the disclosures of which are incorporated herein by reference in their entirety.

TECHNICAL FIELD

The present invention relates to an image forming apparatus including a re-conveyance path.

BACKGROUND ART

There is known an image forming apparatus capable of duplex printing, which comprises an image forming unit including a photoconductor and a transfer member, an exposure device for exposing the photoconductor to light, a sheet feeder unit for feeding a recording sheet to the image forming unit, sheet ejection rollers for ejecting the recording sheet having an image formed thereon by the image forming unit, a conveyance path for conveying the recording sheet, which extends from the sheet feeder unit to the sheet ejection rollers, passing through between the photoconductor and the transfer member of the image forming unit, and a re-conveyance path for conveying the recording sheet having passed through the image forming unit to a position upstream from the photoconductor in the conveyance path.

To be more specific, the sheet ejection rollers are configured to be rotatable in forward and reverse directions such that the recording sheet conveyed along the conveyance path is ejected outside the casing by the forward rotation of the sheet ejection rollers and that a traveling direction of the recording sheet is reversed, after the recording sheet partly protrudes outside the casing, by the reverse rotation of the sheet ejection rollers, whereby the recording sheet is retracted back into the casing. The re-conveyance path is configured such that the recording sheet of which the traveling direction has been reversed by the sheet ejection rollers is caused to pass through a space between the photoconductor and the exposure device and then conveyed to a position upstream from the photoconductor in the conveyance path.

SUMMARY OF THE INVENTION

According to the above image forming apparatus, since a recording sheet of which the traveling direction has been reversed by the sheet ejection rollers passes through the space between the photoconductor and the exposure device, it is necessary that the exposure device starts exposing the photoconductor to light after the trailing edge of the recording sheet passes through between the photoconductor and the exposure device. However, if the length of the re-conveyance path is reduced to downsize the casing of the image forming apparatus, due to the size of a recording sheet (longer in size) conveyed along the re-conveyance path, the leading edge of the recording sheet may disadvantageously reach the position between the photoconductor and the transfer member of the image forming unit before the trailing edge passes through between the photoconductor and the exposure device.

In view of the above, it would be desirable to provide an image forming apparatus which can guide a recording sheet conveyed along the re-conveyance path to the position between the photoconductor and the transfer member only after the recording sheet passes through the space between the photoconductor and the exposure device.

According to a first aspect of the present invention, there is provided an image forming apparatus comprising: a casing; a sheet placement portion configured to receive recording sheets; a photoconductor disposed in the casing and configured to carry a developer image; a transfer member disposed opposite to the photoconductor and configured to transfer the developer image carried on the photoconductor onto a recording sheet while the recording sheet passes through a nip portion between the photoconductor and the transfer member; a sheet feeder unit configured to feed a recording sheet from the sheet placement portion toward the nip portion; an exposure device disposed away from the photoconductor and configured to form an electrostatic latent image on the photoconductor based on image data; a fixing device configured to fix the transferred developer image on the recording sheet; a sheet ejection unit configured to eject the recording sheet with the transferred developer image fixed thereon by the fixing device outside the casing; a conveyance path configured to guide the recording sheet conveyed from the sheet placement portion, passing through the sheet feeder unit, the nip portion between the photoconductor and the transfer member, the fixing device, and the sheet ejection unit in this order; and a re-conveyance path configured to guide the recording sheet conveyed from the fixing device to an upstream-side path which constitutes part of the conveyance path extending upstream from the photoconductor. In this image forming apparatus, the re-conveyance path is branched off from the conveyance path at a position downstream from the fixing device and extends to pass through a space between the photoconductor and the exposure device. Further, the re-conveyance path include a switchback mechanism configured to reverse a traveling direction of a recording sheet conveyed along the re-conveyance path after passing through the space between the photoconductor and the exposure device and to convey the recording sheet toward the upstream-side path.

According to a second aspect of the present invention, there is provided an image forming apparatus comprising: a casing; a sheet placement portion configured to receive recording sheets; an image forming unit disposed inside the casing and configured to form an image on a recording sheet; a sheet feeder unit configured to feed a recording sheet from the sheet placement portion toward the image forming unit; a sheet ejection unit configured to eject the recording sheet with the image formed thereon by the image forming unit outside the casing through a sheet ejection opening formed in the casing; a conveyance path for conveying the recording sheet, which includes an upstream-side path connecting the sheet feeder unit and the image forming unit, and a downstream-side path connecting the image forming unit and the sheet ejection unit; and a re-conveyance mechanism configured to convey the recording sheet having passed through the image forming unit toward the upstream-side path. In this image forming apparatus, the casing has a first opening which is different from the sheet ejection opening. Further, the re-conveyance mechanism is configured to cause the recording sheet conveyed along the downstream-side path to partly protrude outside the casing through the first opening, to reverse a traveling direction of the recoding sheet, and to thereafter guide the recording sheet toward the upstream-side path.

This image forming apparatus may further comprise a photoconductor configured to carry a developer image, and an exposure device disposed away from the photoconductor and configured to form an electrostatic latent image on the photoconductor based on image data. The first opening may be provided between the exposure device and the sheet placement portion.

BRIEF DESCRIPTION OF THE DRAWINGS

To better understand the claimed invention, and to show how the same may be carried into effect, reference will now be made, by way of example only, to the accompanying drawings, in which:

DESCRIPTION OF EMBODIMENT

Figure 1:
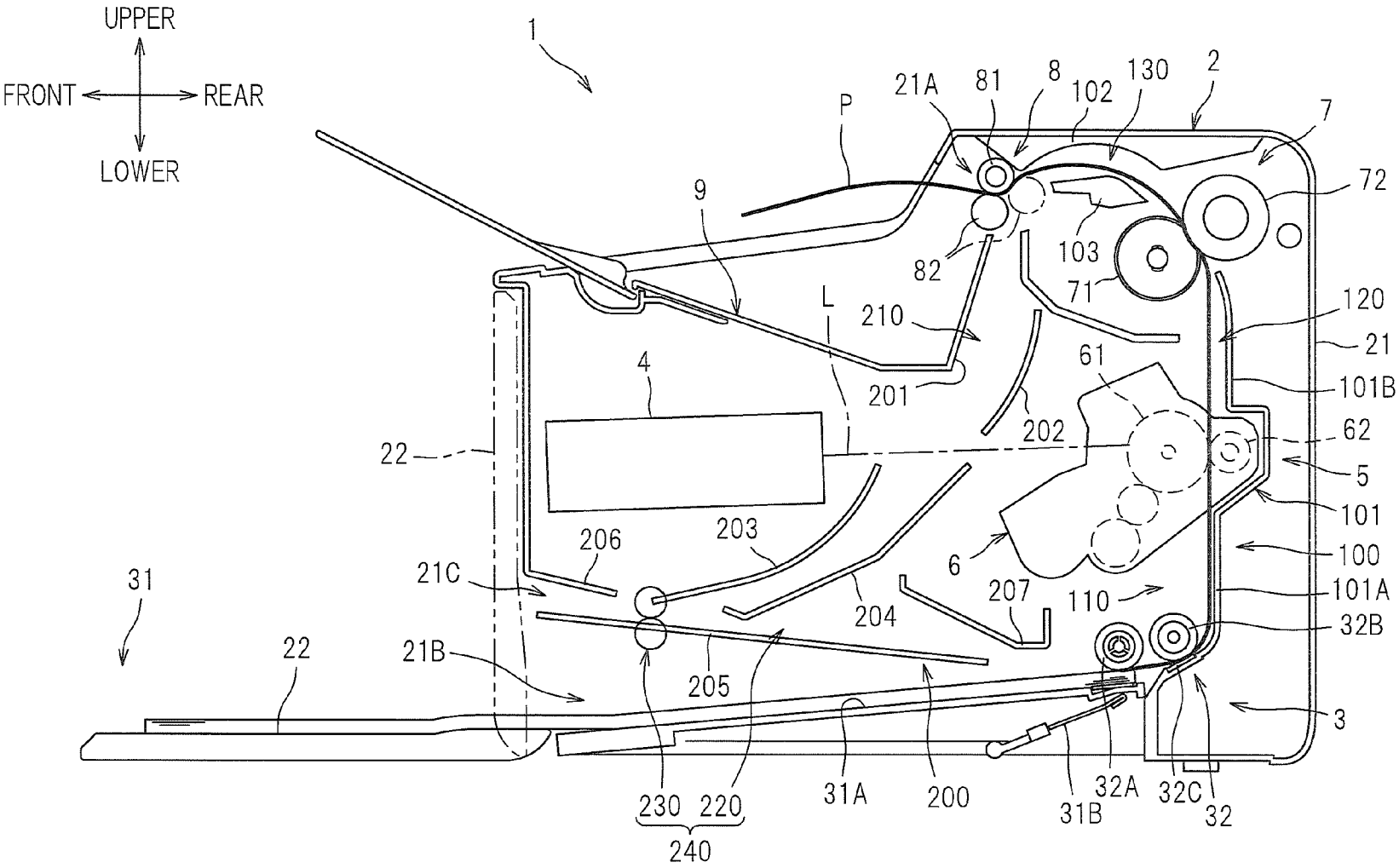
FIG. 1 is a sectional view schematically showing a laser printer according to one exemplary embodiment of the present invention.

A detailed description will be given of an illustrative embodiment of the present invention with reference to the accompanying drawings. In the following description, a general arrangement of a laser printer as an example of an image forming apparatus will be described, and thereafter characteristic features of the present invention will be described in detail.

In the following description, the direction is designated as from the viewpoint of a user who is using (operating) the laser printer. To be more specific, in FIG. 1, the left-hand side of the drawing sheet corresponds to the "front" side of the laser printer, the right-hand side of the drawing sheet corresponds to the "rear" side of the laser printer, the front side of the drawing sheet corresponds to the "right" side of the laser printer, and the back side of the drawing sheet corresponds to the "left" side of the laser printer. Similarly, the direction extending from top to bottom of the drawing sheet corresponds to the "vertical" or "upper-lower" (upward/downward, up/down, upper/lower or top/bottom) direction of the laser printer.

Schematic Arrangement of Laser Printer

As seen in FIG. 1, a laser printer 1 includes a main body 2, a sheet feeder unit 3 for feeding a sheet of paper P (hereinafter simply referred to as a "sheet" P) as an example of a recording sheet, a scanner unit 4 as an example of an exposure device, an image forming unit 5 for forming an image on a sheet P, and a sheet ejection unit 8.

The main body 2 includes a casing 21 and a front cover 22. The casing 2 includes a sheet output tray 9 at an upper portion thereof. The sheet output tray 9 receives a sheet P ejected outside the casing 21 by the sheet ejection unit 8 to be described later. The casing 21 has a wall extending upward from the rear end portion of the upper surface of the sheet output tray 9, and a sheet ejection opening 21A is formed in the wall so that the sheet P is ejected by the sheet ejection unit 8 outside the casing 2 through the sheet ejection opening 21A.

Further, at the front side of the casing 21, there are provided an insertion opening 21B for inserting a batch of sheets P and a first opening 21C. The first opening 21C is an opening that is different from the sheet ejection opening 21A, and is located at a lower portion of the casing 21. The insertion opening 21B is located at a position lower than the first opening 21C.

The front cover 22 covers the front side of the casing 21. A lower end of the front cover 22 is pivotally supported by the casing 22, so that the front cover 22 is swingable in the front-rear directions around the lower end thereof. Accordingly, the insertion opening 21B and the first opening 21C are opened and closed by the front cover 22 when the front cover 22 is swung in the front-rear directions.

The sheet feeder unit 3 is located in a lower portion of the main body 2. The sheet feeder unit 3 includes a sheet feed tray 31, which is an example of a sheet placement portion, for receiving sheets P inserted through the insertion opening 21B, and a sheet feeder unit 32 for feeding a sheet P from the sheet feed tray 31 toward the image forming unit 5.

The sheet feed tray 31 consists of a sheet receiving plate 31A disposed at the lower portion of the casing 21, and the front cover 22 described above. To be more specific, the sheet feed tray 31 is disposed at a position lower than the first opening 21C, and extends from inside to outside the casing 21 beyond the first opening 21C. The sheet receiving plate 31A constitutes the inner portion of the sheet feed tray 31, which is located inside the casing 21, and the front cover 22 constitutes the outer portion of the sheet feed tray 31, which is located outside the casing, when the front cover is opened frontward into a lying back position.

The sheet receiving plate 31A extends from a position in the vicinity of the front side of the casing 21 to a position in the vicinity of the rear side of the casing, and is pivotable in the upper-lower directions around an axis of rotation at the front end portion thereof. The sheet receiving plate 31A is configured such that the rear end portion thereof is caused to move closer to or away from a sheet feed roller 32A to be described later by rotating a lifter member 31B (as an example of a movement mechanism) disposed under the sheet receiving plate 31A with the help of a known mechanism (not shown) and a controller (not shown). With this configuration, the sheet receiving plate 31A lifts the sheets P toward the sheet feed roller 32A each time a sheet P is to be fed, and causes the sheets P to be positioned away from the sheet feed roller 32A while a sheet P is conveyed along a re-conveyance path 200 and guided into a conveyance path 100.

To be more specific, the sheet receiving plate 31A is in a substantially horizontal position, which is a position away from the sheet feed roller 32A, when no print instruction is input. When a print instruction is input, the sheet receiving plate 31A rotates upward and approaches the sheet feed roller 32A. After the sheet feed roller 32A feeds a sheet P, the sheet receiving plate 31A returns to the substantially horizontal position, away from the sheet feed roller 32A.

The sheet feeder unit 32 mainly includes the sheet feed roller 32A and a separation roller 32B, which are examples of rotating members, and a separation pad 32C. The sheet feed roller 32A is disposed above the rear end of the sheet receiving plate 31A. The separation roller 32B is disposed opposite to the separation pad 32C at a position downstream from the sheet feed roller 32A in a sheet conveyance direction along which a sheet P is conveyed.

In this sheet feeder unit 3, the front cover 22 is swung forward into the lying back position to provide the sheet feed tray 31, and a stack of sheets P is placed in the sheet feed tray 31. In this state, the sheet receiving plate 31A is in the substantially horizontal position. The sheets P placed on the sheet feed tray 31 and the sheet feed roller 32A are brought into contact when the sheet receiving plate 31A rotates to lift the rear ends of the sheet P. The sheet feed roller 32A in contact with the sheets P rotates to feed sheets P from the sheet feed tray 31 to the separation roller 32B, and thereafter the sheets P are separated one from the other between the separation roller 32B and the separation pad 32C and fed to the image forming unit 5.

The scanner unit 4 is disposed inside the casing 21, at the front side thereof, between the sheet feed tray 31 and the sheet output tray 9. The scanner unit 4 is disposed away from a photoconductor drum 61 as an example of a photoconductor to be described later. The scanner unit 4 includes a laser beam emitting portion, a polygon mirror, lenses and reflecting mirrors, etc., which are not shown in the drawings. The surface of the photoconductor drum 61 is scanned at high speeds with a laser beam L produced in the scanner unit 4.

The image forming unit 5 is disposed above the sheet feeder unit 32. The image forming unit 5 includes a process cartridge 6 and a fixing device 7.

The process cartridge 6 is disposed inside the casing 21 at a position rearward of the scanner unit 4. The process cartridge 6 includes the photoconductor drum 61, a transfer roller 62 (as an example of a transfer member) disposed adjacent to and at the rear of the photoconductor drum 61, a charger (not shown), and a development roller, a supply roller, and a toner storage chamber, which are shown in the drawings without reference numerals.

In this process cartridge 6, the surface of the rotating photoconductor drum 61 is uniformly charged by the charger, and then exposed to a rapidly sweeping laser beam L from the scanner unit 4. Accordingly, the electric potential of the exposed area lowers, so that an electrostatic latent image associated with image date is formed on the surface of the photoconductor drum 61.

Toner in the toner storage chamber is then supplied to the electrostatic latent image on the photoconductor drum 61 via the development roller, so that a toner image (developer image) is formed on the surface of the photoconductor drum 61. Thereafter, while a sheet P is conveyed through between the photoconductor drum 61 and the transfer roller 62, the toner image carried on the surface of the photoconductor drum 61 is transferred onto the sheet P.

The fixing device 7 is disposed inside the casing 21 at a position above the process cartridge 6. The fixing device 7 mainly includes a heating roller 71 and a pressure roller 72.

The heating roller 71 is configured to heat a sheet P, and a heat source such as a halogen lamp is provided inside the heating roller 71.

The pressure roller 72 is pressed against the heating roller 71 and conveys a sheet P while the sheet P is nipped between the heating roller 71 and the pressure roller 72. The pressure roller 72 is disposed opposite to the heating roller 71 in a position diagonally upward and rearward of the heating roller 71.

In this fixing device 7 configured as described above, the toner image transferred onto the sheet P is thermally fixed while the sheet P passes through between the heating roller 71 and the pressure roller 72. The sheet P with the toner image thermally fixed thereon by the fixing device 7 is conveyed to the sheet ejection unit 8 disposed downstream from the fixing device 7.

The sheet ejection unit 8 includes a drive roller 81, and a driven roller 82 disposed in contact with the drive roller 81 and driven to rotate by the driving force of the drive roller 81. The sheet ejection unit 8 conveys a sheet P while the sheet P is nipped between the drive roller 81 and the driven roller 82.

The drive roller 81 and the driven roller 82 are configured to be movable between a sheet ejection position (shown by solid lines) where the sheet P having passed through the fixing device 7 is ejected outside the casing 21 and a re-conveyance position (shown by chain double-dashed line) where the sheet P having passed through the fixing device 7 is conveyed toward the re-conveyance path 200 to be described later.

To be more specific, while the drive roller 81 and the driven roller 82 are in the sheet ejection position, a contacting portion (i.e., nip portion) between the drive roller 81 and the driven roller 82 are positioned to face the sheet ejection opening 21A. When the drive roller 81 and the driven roller 82 are moved into the re-conveyance position, the driven roller 82 is swung rearward from the sheet ejection position around the drive roller 81, so that the contacting portion (i.e., nip portion) between the drive roller 81 and the driven roller 82 are positioned to face an inlet of the re-conveyance path 200.

When the image formation process ends, the drive roller 81 and the driven roller 82 are positioned in the sheet ejection position under control of the controller (not shown) provided inside the casing 21. In contrast, during the reverse-side printing for printing the reverse side (second side) of the sheet P, the drive roller 81 and the driven roller 82 are positioned in the re-conveyance position under control of the controller.

In the sheet ejection unit 8, the drive roller 81 and the driven roller 82 are positioned in the sheet ejection position when the image formation process ends, so that the sheet P having passed through the fixing device 7 is ejected outside the casing 21 through the sheet ejection opening 21A. When the reverse-side printing is performed on the sheet P, the drive roller 81 and the driven roller 82 are positioned in the re-conveyance position, so that the sheet P having passed through the fixing device 7 is conveyed to the re-conveyance path 200 without passing through the sheet ejection opening 21A.

Detailed Structure of Conveyance Path and Re-conveyance Path

Detailed description will be given of the conveyance path 100 and the re-conveyance path 200 as an example of a re-conveyance mechanism, which are provided inside the casing 21.

As seen in FIG. 1, the conveyance path 100 has a generally C-shaped configuration and extends to guide a sheet P placed on the sheet feed tray 31, passing through the sheet feeder unit 32, a nip portion between the photoconductor drum 61 and the transfer roller 62, the fixing device 7, and the sheet ejection unit 8 in this order. To be more specific, the conveyance path 100 is defined by a first guide member 101, a second guide member 102, and a third guide member 103. The conveyance path 100 includes a first path 110, a second path 120, and a third path 130.

The first path 110 is an example of an upstream-side path which constitutes part of the conveyance path 100 extending upstream from the photoconductor drum 61. The first path 110 connects the sheet feeder unit 32 and the image forming unit 5 (nip portion between the photoconductor drum 61 and the transfer roller 62). The first path 110 is defined mainly by a lower portion 101A of the first guide member 101; the first guide member 101 extends substantially in the vertical direction and detours around the rear side of the process cartridge 6.

The lower portion 101A of the first guide member 101 extends rearward from the sheet feed tray 31, through the sheet feeder unit 32, and is then directed upward to a position lower than the nip portion between the photoconductor drum 61 and the transfer roller 62.

The second path 120 is a path provided inside the image forming unit 5. The second path 120 is defined mainly by an upper portion 101B of the first guide member 101.

The upper portion 101B of the first guide member 101 extends upward from a position higher than the nip portion between the photoconductor drum 61 and the transfer roller 62 to a position lower than the nip portion between the heating roller 71 and the pressure roller 72 of the fixing device 7.

The third path 130 is an example of a downstream-side path which constitutes part of the conveyance path 100 extending downstream from the fixing device 7. The third path 130 connects the image forming unit 5 (fixing device 7) and the sheet ejection unit 8. The third path 130 is defined mainly by the second guide member 102 and the third guide member 103.

The second guide member 102 has a substantially arcuate guide surface which is recessed upward in section, and extends frontward from an exit of the fixing device 7 to the sheet ejection unit 8.

The third guide member 103 is disposed below and opposite to the second guide member 102. The third guide member 103 defines a path for a sheet with the second guide member 102. The third guide member 103 extends frontward from the exit of the fixing device 7 to an inlet of a return path 210 to be described later.

The re-conveyance path 200 is configured to cause a sheet P having passed through the fixing device 7 (image forming unit 5) to partly protrude outside the casing 21 through the first opening 21C, to reverse the traveling direction of the sheet P, and to thereafter guide the sheet P toward the first path 110. The re-conveyance path 200 consists of a return path 210 and a switchback path 220.

The return path 210 is a path for connecting the third path 130 and the switchback path 220. The return path 210 is branched off from the third path 130 (conveyance path 100) at a position downstream from the fixing device 7 and extends diagonally downward and frontward to pass through a space between the photoconductor drum 61 and the scanner unit 4 and to merge with the switchback path 220 at an intermediate portion of the switchback path 220. With this configuration, when a sheet P having passed through the return path 210 enters the switchback path 220, the sheet P is guided to travel frontward in the switchback path 20 toward the first opening 21C.

More specifically, the return path 210 is defined by a fourth guide member 201, a fifth guide member 202, a sixth guide member 203, and a seventh guide member 204.

The fourth guide member 201 is a wall of the casing 21, in which the sheet ejection opening 21A is formed. The fourth guide member 201 extends downward from a lower side of the sheet ejection unit 8 to a position higher than a path through which a laser beam L emitted from the scanner unit 4 passes (hereinafter referred to as a "light path").

The fifth guide member 202 is disposed at the rear of the fourth guide member 201, opposite to the fourth guide member 201. The fifth guide member 202 defines a path for a sheet P with the fourth guide member 201. The fifth guide member 202 extends diagonally downward and frontward from the lower side of the sheet ejection unit 8 to a position higher than the light path.

The sixth guide member 203 extends diagonally downward and frontward from a position lower than the light path on an extension of the lower end of the fourth guide member 201, to a pair of conveyance rollers 230 to be described later.

The seventh guide member 204 is disposed at the rear of the sixth guide member 203, opposite to the sixth guide member 203. The seventh guide member 204 defines a path for a sheet P with the sixth guide member 203. The seventh guide member 204 extends diagonally downward and frontward from a position lower than the range where the laser beam L emitted from the scanner unit 4 passes, on an extension of the lower end of the fifth guide member 202, toward the rear side of the conveyance rollers 230 to be described later. Further, the lower end portion (end portion closer to the switchback path 220) of the seventh guide member 204 is bent in a diagonally upward and frontward direction, such that the front end of the seventh guide member 204 faces inward of the return path 210 toward the sixth guide member 203.

To be more specific, the lower end portion of the seventh guide member 204 is tilted with respect to the tangential line passing through the nip portion of the conveyance rollers 230 such that the switchback path 220 (path for a sheet P) is enlarged as it goes upstream in the sheet conveyance direction, along which the sheet P of which the traveling direction has been reversed is conveyed. This configuration prevents the sheet P conveyed along the switchback path 220 from the front side toward the rear side from entering the return path 210, and makes it possible to smoothly guide the sheet P toward the sheet feeder unit 32.

Further, because of the return path 210 configured as described above, the laser beam L emitted from the scanner unit 4 can pass through a space between the fourth guide member 201 and the sixth guide member 203, and a space between the fifth guide member 202 and the seventh guide member 204, so that the return path 210 does not block the laser beam L.

The switchback path 220 is a path for connecting the first opening 21C, the return path 210, and the sheet feeder unit 32. In the vertical direction, the switchback path 220 is located between the sheet feed tray 31 and the scanner unit 4. In the front-rear direction, the switchback path 220 extends rearward from the front side of the casing 21 along the sheet feed tray 31, and merges with the first path 110. Further, the first opening 21C is provided at a position (i.e., front end) corresponding to the opposite end of the switchback path 220 from the first path 110. The sheet P guided along the switchback path 220 is allowed to partly protrude outside the casing 21 through the first opening 21C.

More specifically, the switchback path 220 is defined by an eighth guide member 205, a ninth guide member 206, and a tenth guide member 207.

The eighth guide member 205 extends diagonally downward and rearward from the lower edge of the first opening 21C to a position in front of the sheet feeder unit 32. The rear end of the eighth guide member 205 extends to a position where it does not contact the sheets P placed on the sheet receiving plate 31A after the sheet receiving plate 31A rotates upward to approach the sheet feed roller 32A. In order to stably convey a sheet P from the eighth guide member 205 to the sheet feed roller 32A, a film or the like for guiding the sheet P may be provided at the rear end portion of the eighth guide member 205.

The ninth guide member 206 is disposed above the front portion of the eighth guide member 205 so as to face the eighth guide member 205. The ninth guide member 206 defines a path for a sheet P with the eighth guide member 205. The ninth guide member 206 extends diagonally downward and rearward from the upper edge of the first opening 21C to a position in front of the conveyance rollers 230. With this configuration, the sheet P conveyed along the front part of the switchback path 220 from the front side toward the rear side can be guided to the conveyance rollers 230.

The tenth guide member 207 is disposed above the rear portion of the eighth guide member 205 so as to face the eighth guide member 205. The tenth guide member 207 defines a path for a sheet P with the eighth guide member 205. The tenth guide member 207 extends rearward from the rear side of the seventh guide member 204 in the return path 210 to a position in front of the sheet feeder unit 32. To be more specific, the tenth guide member 207 is tilted downward toward the rearward direction such that the switchback path 220 (path for a sheet P) narrows as it goes in a direction toward the sheet feeder unit 32. With this configuration, the sheet P can be guided toward the sheet feed roller 32A.

The conveyance rollers 230 are arranged at a position shifted from a merging position where the return path 210 is merged with the switchback path 220 in a direction away from the first path 110, namely, at a position of the switchback path 220 close to the first opening 21C. The conveyance rollers 230 are arranged to face a sheet P guided along the switchback path 220. The switchback path 220 and the conveyance rollers 230 constitute a switchback mechanism 240 configured to reverse the traveling direction of a sheet P having passed through the return path 210 and to convey the sheet P toward the first path 110.

The conveyance rollers 230 are configured to be rotatable in forward and reverse directions. To be more specific, the conveyance rollers 230 rotate forward to guide a sheet P in the switchback path 220 in a direction away from the first path 110, namely, toward the first opening 21C. Meanwhile, the conveyance rollers 230 rotate reversely to guide the sheet P in the switchback path 220 in a direction toward the first path 110.

The conveyance rollers 230 are controlled by the controller such that they are driven to rotate forward while the sheet P is being conveyed along the return path 210 and to rotate reversely after the tailing end of the sheet P having conveyed along the return path 210 reaches the position between the return path 210 and the switchback path 220 (i.e., after the sheet P passes through the lower end of the seventh guide member 204).

Accordingly, the switchback mechanism 240 can guide the sheet P from the return path 210 to the switchback path 220, using the conveyance rollers 230, so as to cause the sheet to partly protrude outside the casing 21 through the first opening 21C. Thereafter, after the trailing edge of the sheet P reaches the merging position where the return path 210 is merged with the switchback path 220, the switchback mechanism 240 reverses the traveling direction of the sheet P, so that the sheet P can be conveyed toward the sheet feeder unit 32 with the trailing edge positioned ahead.

Further, the switchback path 220 is configured to allow sheets P to be inserted through the first opening 21C and to feed a sheet P from the inserted sheets P toward the conveyance path 100 (first path 110). In other words, the switchback path 220 also works as a manual sheet feeding path, and the first opening 21C also works as an opening for manual sheet feeding (second opening). During printing a sheet P by the manual sheet feeding, the controller controls the conveyance rollers 230 to rotate reversely.

Operation of the laser printer 1 configured as described above will be described below.

To perform duplex printing, as seen in FIG. 1, the lifter member 31B is raised first, so that sheets P placed on the sheet receiving plate 31A approach the sheet feeder unit 32. This causes the sheets P placed on the sheet receiving plate 31A (sheet feed tray 31) to be fed out by the sheet feeder unit 32, toward the image forming unit 5 via the first path 110. During this time, the laser beam L emitted from the scanner unit 4 sweeps the surface of the photoconductor drum 61 for high speed scanning.

Figure 2:
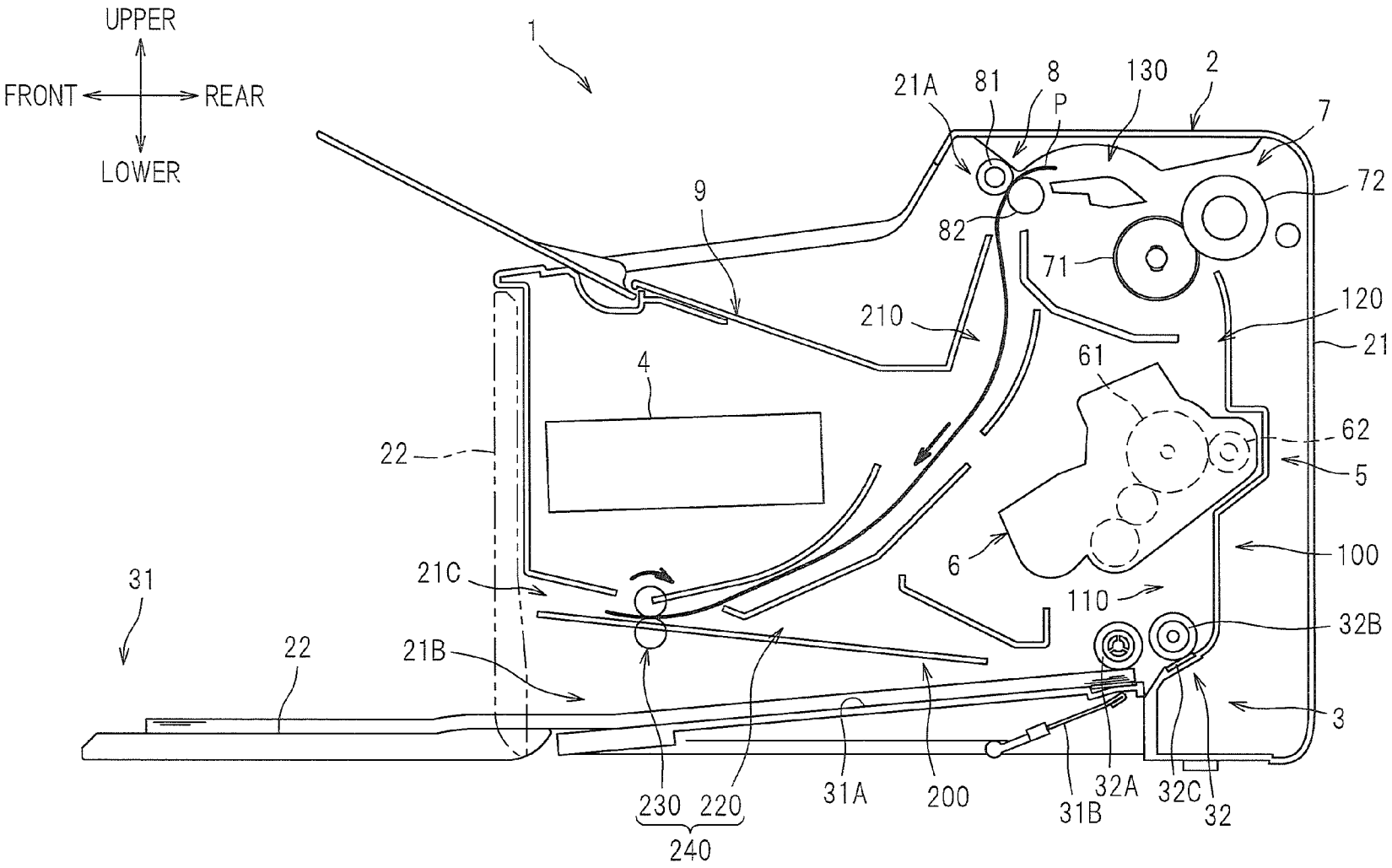
FIG. 2 is a sectional view illustrating a state in which the leading edge of a sheet conveyed along the re-conveyance path has passed through the conveyance rollers.

The sheet P fed to the image forming unit 5 then passes through the nip portion between the photoconductor drum 61 and the transfer roller 62, whereby an image is formed on the surface of the sheet P. Thereafter, the sheet P is conveyed to the fixing device 7 via the second path 120. The sheet P having passed through the fixing device 7 is then conveyed to the third path 130. In the sheet ejection unit 8, as seen in FIG. 2, the drive roller 81 and the driven roller 82 are moved into the re-conveyance position, so that the sheet P conveyed along the third path 130 is guided toward the return path 210 without passing through the sheet ejection opening 21A.

The sheet P is conveyed along the return path 210, and after passing through the space between the scanner unit 4 and the photoconductor drum 61, the sheet P is guided to the conveyance rollers 230 provided in the switchback path 220. It is noted that the image formation on the surface of the sheet P is completed by the time when the leading edge of the sheet P reaches the space (light path) between the scanner unit 4 and the photoconductor drum 61, and so the irradiation with the laser beam L is not blocked by the sheet P.

Figure 3:
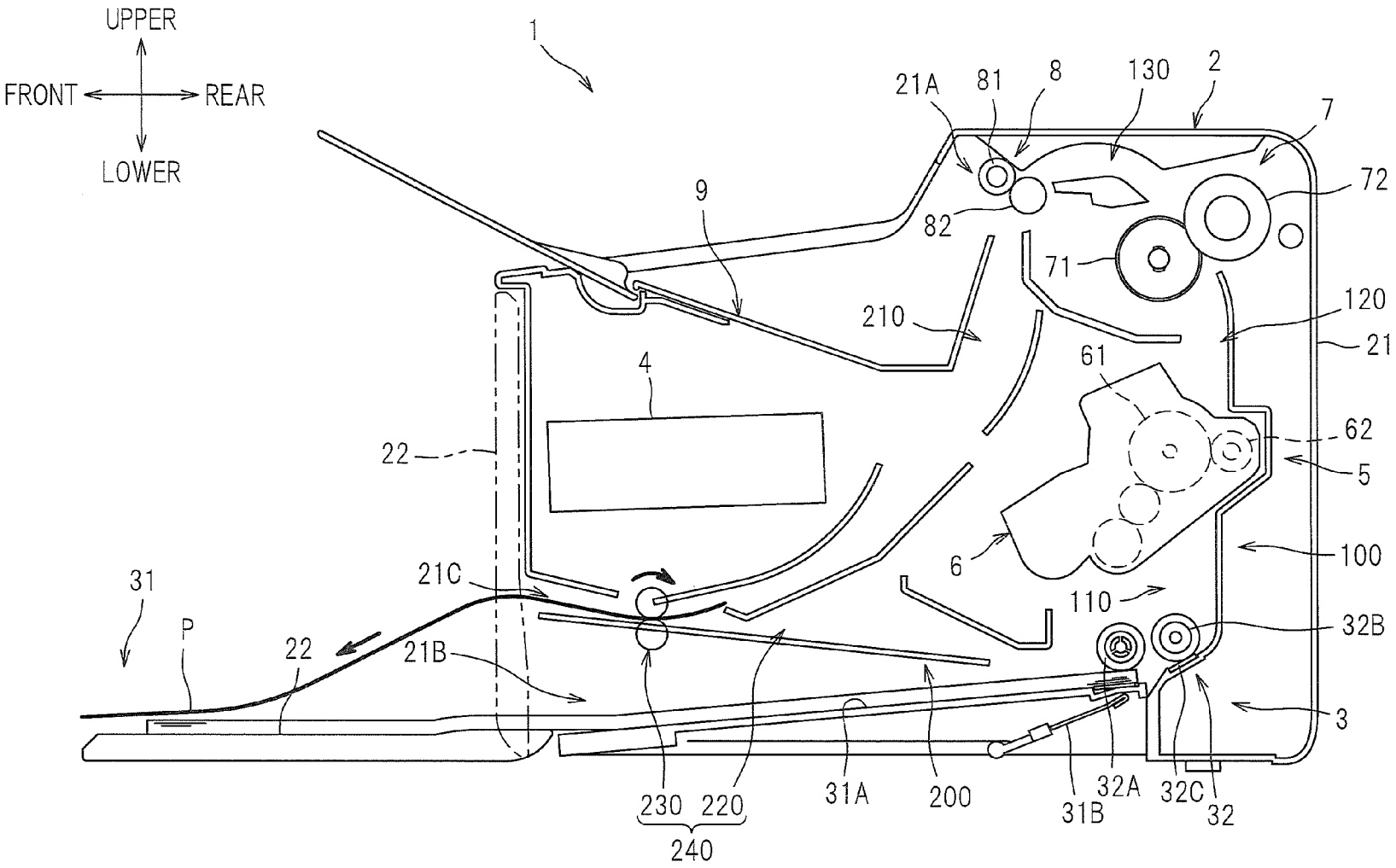
FIG. 3 is a sectional view illustrating a state just before reversing rotations of the conveyance rollers.

Thereafter, as seen in FIG. 3, the sheet P conveyed from the return path 210 to the switchback path 220 is guided by the conveyance rollers 230 toward the first opening 21C until the trailing edge of the sheet P passes through the return path 210. During this time, the leading edge of the sheet P protrudes outside the casing 21 through the first opening 21C; an protruding part of the sheet P is supported by the front cover 22 which constitutes the sheet feed tray 31.

Figure 4:
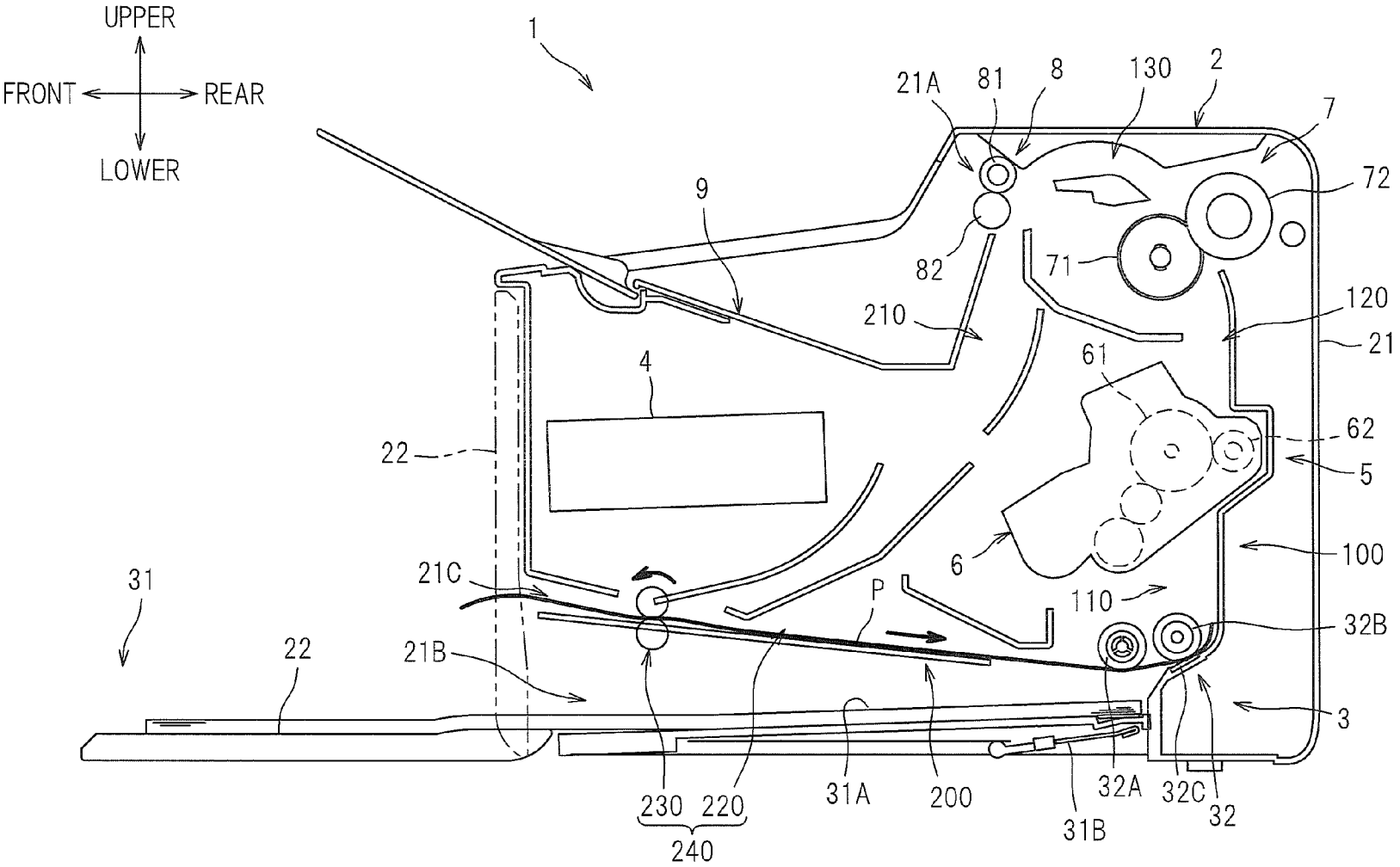
FIG. 4 is a sectional view illustrating a state after a sheet conveyed along the re-conveyance path has been conveyed to the sheet feeder unit.

Once the trailing edge of the sheet P passes through the return path 210 and enters the switchback path 220, the conveyance rollers 230 rotate reversely. Accordingly, as seen in FIG. 4, the sheet P conveyed along the switchback path 220 is guided toward the sheet feeder unit 32 (first path 110) with the trailing edge positioned ahead. While the sheet P is guided along the switch back path 220, the lifter member 31B is lowered and the sheets P placed on the sheet receiving plate 31A are positioned away from the sheet feeder unit 32.

In this way, the sheet P having passed through the fixing device 7 and conveyed along the re-conveyance path 200 is conveyed upside down toward the conveyance path 100, and an image is formed on the reverse surface of the sheet P. In order to form an image on the reverse surface of the sheet P, the irradiation with the laser beam L starts after the trailing edge of the sheet P passes through the space (light path) between the scanner unit 4 and the photoconductor drum 61. Thereafter, as seen in FIG. 1, the sheet P having the image formed thereon is ejected outside the casing 21 by the driving roller 81 and the driven roller 82 of the sheet ejection unit 8, which have been moved into the sheet ejection position.

With the configuration of the laser printer 1 according to this embodiment, the following advantageous effects can be achieved.

Since the trailing edge of the sheet P having passed through the space (light path) between the photoconductor drum 61 and the scanner unit 4 in the re-conveyance path 200 (return path 210) is reversed by the switchback mechanism 240 and positioned ahead, and then guided toward the nip position between the photoconductor drum 61 and the transfer roller 62, even if the size of the sheet P is large, the laser printer 1 can reliably guide the sheet P conveyed along the re-conveyance path 200 to the nip portion between photoconductor drum 61 and the transfer roller 62 after the sheet P passes through the space between the photoconductor drum 61 and the scanner unit 4.

Further, since the sheet P conveyed along the switchback path 220 toward the first opening 21C is allowed to partly protrude outside the casing 21 through the first opening 21C, the size of the casing 21 can be reduced as compared to the configuration in which the traveling direction of the sheet P is reversed within the casing 21.

Since the first opening 21C for causing the sheet P to partly protrude outside the casing 21 during the switchback is provided separately from the sheet ejection opening 21A, even if the sheet P partly protrudes outside the casing 21 and is reversed during the duplex printing, the user is less likely to consider the protruding sheet P as a printed sheet P and to pull out the sheet P by mistake.

Further, since the re-conveyance path 200 is configured to cause the sheet P conveyed along the third path 130 to partly protrude outside the casing 21 through the first opening 21C, to reverse the traveling direction of the sheet P, and to thereafter guide the sheet P toward the first path 110, and further the first opening 21C is provided between the scanner unit 4 and the sheet feed tray 31, the trailing edge of the sheet P having passed through the space (light path) between the photoconductor drum 61 and the scanner unit 4 in the re-conveyance path 200 (return path 210) is reversed and positioned ahead and then guided toward the nip portion between the photoconductor drum 61 and the transfer roller 62. With this configuration, even if the size of the sheet P is large, the laser printer 1 can reliably guide the sheet P conveyed along the re-conveyance path 200 to the nip portion between photoconductor drum 61 and the transfer roller 62 after the sheet P passes through the space between the photoconductor drum 61 and the scanner unit 4.

Since the first opening 21C is located at the lower portion of the casing 21, the under surface of the sheet P protruding outside the casing 21 through the first opening 21C can be supported by the sheet feed tray 31 (part of the sheet feed tray 31 which extends outside beyond the first opening 21C) located just under the first opening 21C. Even by the configuration in which the sheet feed tray 31 does not extend outside from the casing 21C, if the laser printer 1 is placed on the installation surface and the installation surface extends frontward of the first opening 21C, the installation surface can support the under surface of the sheet P protruding outside the casing 21 through the first opening 21C. This is advantageous, as compared to the configuration in which the first opening 21C is located at the upper portion of the casing 21 and the sheet is hung down from the first opening, because the sheet P partly protruding outside through the first opening 21C can be held in a substantially horizontal posture and easily retracted back into the casing 21 during reversing the sheet P.

Since the sheet feed tray 31 extends from inside to outside the casing 21 beyond the first opening 21C, the sheet feed tray 31 can reliably support the sheet P partly protruding outside through the first opening 21C, even if the laser printer 1 is installed on a stand and no installation surface is present in front of the first opening 21C. With this configuration, the sheet P partly protruding outside through the first opening 21C can be held in a substantially horizontal posture and easily retracted back into the casing during reversing the sheet P.

Further, since part of the sheet feed tray 31 which extends outside the casing 21 is formed by the front cover 22 for opening and closing the first opening 21C, the laser printer 1 becomes compact when not in use. Closing the front cover 22 can prevent dust from entering the casing 21 through the first opening 21C.

Since the downstream end of the re-conveyance path 200 (switchback path 220) is connected to the sheet feeder unit 32, it is not necessary to provide, other than the sheet feeder unit 32, a feed-out member for feeding a sheet P conveyed from the re-conveyance path 200 toward the nip portion between the photoconductor drum 61 and the transfer roller 62 (image forming unit 5). This can reduce the number of the required parts. Further, since only the sheet feeder unit 32 is provided as a member for feeding a sheet P toward the nip portion between the photoconductor drum 61 and the transfer roller 62, the control for determining timings of the image formation and the like can be simplified.

Since the lifter member 31B lowers to position the sheet receiving plate 31A away from the sheet feeder unit 32 while a sheet P is being guided along the re-conveyance path 200 toward the conveyance path 100, the risk of feeding a sheet P placed on the sheet receiving plate 31A (sheet feed tray 31) by mistake can be reduced.

Further, since the switchback mechanism 240 is provided between the sheet feed tray 31 and the scanner unit 4, the casing can be downsized as compared to the configuration in which the switchback mechanism 240 is provided on the opposite side of (above) the scanner unit 4 from the sheet feed tray 31.

Further, since the drive roller 81 and the driven roller 82 of the sheet ejection unit 8 are configured such that the sheet P is ejected outside the casing 21 when they are in the sheet ejection position and that the sheet P is conveyed toward the return path 210 when they are in the re-conveyance position, and further the rollers for discharging the sheet P outside the casing 21 and the rollers for guiding the sheet P along the re-conveyance path 200 are the same rollers, the size of the laser printer 1 can be reduced as compared to the configuration in which these rollers are provided individually.

Further, since the switchback path 220 also works as a manual sheet feeding path, the casing 21 can be downsized as compared to the configuration in which the manual sheet feeding path is provided separately from the switchback path 220.

Since the first opening 21C for causing the sheet P conveyed along the re-conveyance path 200 to partly protrude outside the casing 21 and the opening for manual sheet feeding (second opening) through which sheets P are inserted are the same opening, the structure of the laser printer 1 can be simplified.

Further, since the scanner unit 4 is located between the sheet feed tray 31 and the sheet output tray 9, the casing 21 can be downsized as compared to the configuration in which the scanner unit 4 is provided to a position other than that between the sheet feed tray 31 and the sheet output tray 9.

Although an illustrative embodiment of the present invention have been described in detail, the present invention is not limited to this specific embodiment. It is to be understood that various changes and modifications, such as those described below, may be made without departing from the scope of the appended claims. In the following description, parts similar to those previously described in the above embodiment are denoted by the same reference numerals and detailed description thereof will be omitted.

Figure 5:
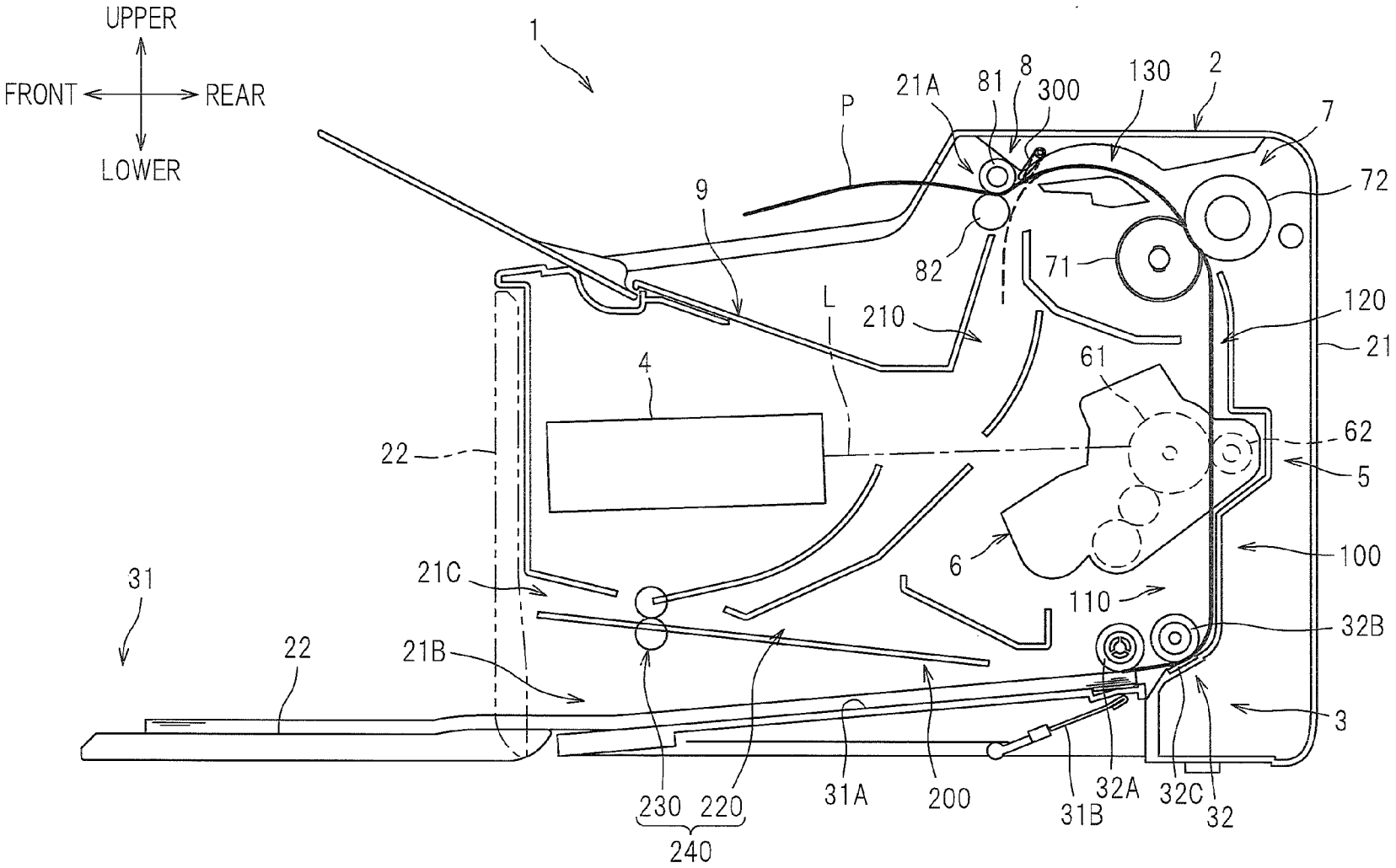
FIG. 5 is a sectional view schematically showing the laser printer according to a modified embodiment.

In the above exemplary embodiment, the drive roller 81 and the driven roller 82 of the sheet ejection unit 8 are configured to be movable between the sheet ejection position and the re-conveyance position, so that the traveling direction of the sheet P conveyed along the third path 130 can be switched. However, the present invention is not limited to this specific configuration. For example, as seen in FIG. 5, a flapper 300 as an example of a switching member is swingably provided in the third path 130, between the fixing device 7 and the sheet ejection unit 8; the traveling direction of a sheet P conveyed along the third path 130 can be switched by the flapper 300.

To be more specific, the flapper 300 extends downward from above the third path 130 so as to intersect the third path 130 and configured to be switchable between a sheet ejection posture (shown by solid line) in which a distal end of the flapper is directed toward the sheet ejection unit 8 and a re-conveying posture (shown by broken line) in which the distal end of the flapper is directed toward the inlet of the re-conveyance path 200; the sheet P passed through the fixing device 7 is guided to the sheet ejection unit 8 by the flapper 300 in the sheet ejection posture, whereas guided to the return path 210 (re-conveyance path 200) by the flapper 300 in the re-conveying posture.

When the image formation process ends, the flapper 300 is switched into the sheet ejection posture under control of the controller. When the reverse side of the sheet P is printed, the flapper 300 is switched into the re-conveying posture under control of the controller.

The traveling direction of a sheet P conveyed along the third path 130 can be reversed by a mechanism using the flapper 300, which is less complicated in structure than that described in the above embodiment.

In the above exemplary embodiment, the first opening 21C for causing a sheet P to partly protrude outside the casing 21 during the switchback and the opening for manual sheet feeding (second opening) are the same opening. However, the present invention is not limited to this specific configuration. For example, the casing 21 may have a second opening which is not the same as the first opening 21C, and a sheet P inserted from the second opening can be fed to the switchback path 220.

Further, in the above exemplary embodiment, two rollers including the sheet feed roller 32A and the separation roller 32B are provided in the sheet feeder unit 32. However, only one roller may be provided in the sheet feeder unit or alternatively, three or more rollers may be provided in the sheet feeder unit.

In the above exemplary embodiment, the lifter member 31B configured to cause the sheet receiving plate 31A to be moved upward or downward is exemplified as a movement mechanism, and the sheet receiving plate 31A is moved closer to or away from the sheet feeder unit 32 by the lifter member 31B. However, the present invention is not limited to this specific configuration. For example, the sheet feed roller 32A may be movable upward or downward relative to the sheet receiving plate 31A, and a movement mechanism for moving the sheet feed roller 32A may be provided. In this embodiment, when a sheet P is conveyed from the sheet feed tray 31 to the conveyance path 100, the movement mechanism causes the sheet feed roller 32A to approach the sheet receiving plate 31A, whereas when a sheet P is conveyed from the re-conveyance path 200 to the conveyance path 100, the movement mechanism causes the sheet feed roller 32A to be moved away from the sheet receiving plate 31A.

In the above exemplary embodiment, the conveyance rollers 230 are located at a position shifted from the merging position where the return path 210 and the switchback path 220 are merged together in a direction toward the first opening 21C. However, the conveyance rollers 230 may be provided at the merging position between the return path 210 and the switchback path 220.

Further, in the above exemplary embodiment, the sheet receiving plate 31A is moved away from the sheet feed roller 32A (see FIG. 4) when a sheet P is guided into the switchback path 220. However, the present invention is not limited to this specific configuration. For example, the sheet receiving plate 31A may be moved away from the sheet feed roller 32A after the trailing edge of a sheet P placed on the sheet receiving plate 31A reaches the separation roller 32B.

In the above exemplary embodiment, the photoconductor drum 61 is employed as an example of a photoconductor. However, a belt-type photoconductor may be employed instead.

In the above exemplary embodiment, the photoconductor drum 61 is exposed to light by the scanner unit 4. However, the present invention is not limited to this specific configuration. For example, an LED unit may be provided adjacent to the photoconductor drum 61 as an exposure device for exposing the photoconductor drum 61 to light. In this embodiment, the return path 210 of the re-conveyance path 200 may extend to pass along the front side of the photoconductor drum 61 and the LED unit.

Further, in the above exemplary embodiment, a sheet P such as a cardboard, a postcard, and a thin paper, etc. is used as an example of a recording sheet. However, an OHP sheet may be used as the recording sheet.

What is claimed is:

1. An image forming apparatus comprising:

a casing;

a sheet placement portion configured to receive recording sheets;

a photoconductor disposed in the casing and configured to carry a developer image;

a transfer member disposed opposite to the photoconductor and configured to transfer the developer image carried on the photoconductor onto a recording sheet while the recording sheet passes through a nip portion between the photoconductor and the transfer member;

a sheet feeder unit configured to feed a recording sheet from the sheet placement portion toward the nip portion;

an exposure device disposed away from the photoconductor and configured to form an electrostatic latent image on the photoconductor based on image data;

a fixing device configured to fix the transferred developer image on the recording sheet;

a sheet ejection unit configured to eject the recording sheet with the transferred developer image fixed thereon by the fixing device outside the casing;

a conveyance path configured to guide the recording sheet conveyed from the sheet placement portion, passing through the sheet feeder unit, the nip portion between the photoconductor and the transfer member, the fixing device, and the sheet ejection unit in this order; and a re-conveyance path branched off from the conveyance path at a position downstream from the fixing device and extending to pass through a space between the photoconductor and the exposure device, the re-conveyance path configured to guide the recording sheet conveyed from the fixing device to an upstream-side path which constitutes part of the conveyance path extending upstream from the photoconductor, the re-conveyance path comprising a switchback mechanism positioned downstream of a portion of the re-conveyance path where a recording sheet passes through the space between the photoconductor and the exposure device, the switchback mechanism configured to reverse a traveling direction of the recording sheet conveyed along the re-conveyance path and to convey the recording sheet toward the upstream-side path.

2. The image forming apparatus according to claim 1, further comprising a sheet output tray disposed outside the casing and configured to receive a recording sheet ejected by the sheet ejection unit outside the casing, wherein the conveyance path has a generally C-shaped configuration, and the exposure device is located between the sheet placement portion and the sheet output tray.

3. The image forming apparatus according to claim 2, wherein the switchback mechanism comprises a switchback path extending from a position between the sheet placement portion and the exposure device to the upstream-side path along the sheet placement portion, wherein the re-conveyance path includes a return path extending to pass through the space between the photoconductor and the exposure device and merging with the switchback path at an intermediate portion of the switchback path, and wherein the switchback mechanism is configured to guide the recording sheet conveyed along the return path in a direction away from the upstream-side path using the switchback path, to reverse the traveling direction of the recording sheet, and to thereafter guide the recording sheet in a direction toward the up stream-side path using the switchback path.

4. The image forming apparatus according to claim 3, wherein the casing has a first opening at a position corresponding to an opposite end of the switchback path from the upstream-side path, and wherein a recording sheet guided along the switchback path is caused to partly protrude outside the casing through the first opening.

5. The image forming apparatus according to claim 4, wherein the casing has a second opening through which a recording sheet is inserted, and wherein the switchback path functions as a manual sheet feeding path for guiding the recording sheet inserted into the second opening toward the conveyance path.

6. The image forming apparatus according to claim 5, wherein the second opening and the first opening are the same opening.

7. The image forming apparatus according to claim 3, wherein the switchback mechanism comprises at least one conveyance roller arranged to face the recording sheet guided along the return path and configured to be rotatable in forward and reverse directions, and the conveyance roller is located at a merging position where the return path and the switchback path are merged together or at a position shifted from the merging position in a direction away from the upstream-side path, and wherein the conveyance roller is configured to rotate forward to guide the recording sheet in the switchback path in a direction away from the upstream-side path and to rotate reversely to guide the recording sheet in the switchback path in a direction toward the upstream-side path.

8. The image forming apparatus according to claim 1, wherein the re-conveyance path is connected to the sheet feeder unit.

9. The image forming apparatus according to claim 8, wherein the sheet feeder unit comprises at least one rotating member, wherein the image forming apparatus comprises a movement mechanism configured to cause one of the recording sheets placed on the sheet placement portion and the rotating member to be moved closer to or away from the other one of the rotating member and the recording sheets, and wherein the movement mechanism causes the one of the recording sheets and the rotating member to be moved away from the other of the recording sheets and the rotating member before the recording sheet conveyed along the re-conveyance path is guided into the conveyance path.

10. The image forming apparatus according to claim 9, wherein the at least one rotating member comprises a sheet feed roller configured to contact with an uppermost recording sheet placed on the sheet placement portion and rotate to convey the recording sheet, and a separation roller disposed downstream from the sheet feed roller in the conveyance path, and wherein the movement mechanism is configured to cause one of the recording sheets placed on the sheet placement portion and the sheet feed roller to be moved closer to or away from the other one of the sheet feed roller and the recording sheets.

11. The image forming apparatus according to claim 1, wherein the sheet ejection unit comprises a drive roller, and a driven roller driven to rotate by a driving force of the drive roller, by which the recording sheet is conveyed while being nipped between them, and wherein the drive roller and the driven roller are configured to be movable between a sheet ejection position where the recording sheet passed through the fixing device is ejected outside the casing and a re-conveyance position where the recording sheet passed through the fixing device is conveyed toward the re-conveyance path.

12. The image forming apparatus according to claim 1, wherein a switching member configured to be switchable between a sheet ejection posture and a re-conveying posture is provided in the conveyance path, between the fixing device and the sheet ejection unit, and the recording sheet passed through the fixing device is guided toward the sheet ejection unit by the switching member in the sheet ejection posture and guided to the re-conveyance path by the switching member in the re-conveying posture.

13. An image forming apparatus comprising:

a casing having a first opening;

a sheet placement portion configured to receive recording sheets;

an image forming unit disposed inside the casing and configured to form an image on a recording sheet;

a sheet feeder unit configured to feed a recording sheet from the sheet placement portion toward the image forming unit;

a sheet ejection unit configured to eject the recording sheet with the image formed thereon by the image forming unit outside the casing through a sheet ejection opening formed in the casing;

a conveyance path for conveying the recording sheet, which includes an upstream-side path connecting the sheet feeder unit and the image forming unit, and a downstream-side path connecting the image forming unit and the sheet ejection unit; and a re-conveyance mechanism configured to convey the recording sheet having passed through the image forming unit toward the upstream-side path, the re-conveyance mechanism including a switchback path connecting the first opening and the upstream-side path, and a return path connecting the downstream-side path and the switchback path, and the re-conveyance mechanism being configured to guide the recording sheet conveyed along the return path in a direction toward the first opening, to reverse a traveling direction of the recording sheet, and to thereafter guide the recording sheet in a direction toward the upstream-side path using the switchback path wherein the first opening is different from the sheet ejection opening, and wherein the re-conveyance mechanism is configured to cause the recording sheet conveyed along the downstream-side path to partly protrude outside the casing through the first opening, to reverse the traveling direction of the recording sheet, and to thereafter guide the recording sheet toward the upstream-side path, wherein the casing has a second opening through which a recording sheet is inserted, and wherein the switchback path functions as a manual sheet feeding path for guiding the recording sheet inserted into the second opening toward the conveyance path, and wherein the second opening and the first opening are the same opening.

14. The image forming apparatus according to claim 13, further comprising a photoconductor configured to carry a developer image, and an exposure device disposed away from the photoconductor and configured to form an electrostatic latent image on the photoconductor based on image data, wherein the first opening is provided between the exposure device and the sheet placement portion.

15. The image forming apparatus according to claim 13, wherein the switchback path comprises at least one conveyance roller arranged to face the recording sheet guided along the switchback path and configured to be rotatable in forward and reverse directions, and the conveyance roller is located at a merging position where the return path and the switchback path are merged together or at a position shifted from the merging position toward the first opening, and wherein the conveyance roller is configured to rotate forward to guide the recording sheet in the switchback path toward the first opening and to rotate reversely to guide the recording sheet in the switchback path toward the upstream-side path.

16. The image forming apparatus according to claim 13, wherein the sheet placement portion is provided below the first opening and extends from inside to outside the casing beyond the first opening.

17. The image forming apparatus according to claim 16, wherein a cover for opening and closing the first opening constitutes the sheet placement portion.

18. The image forming apparatus according to claim 13, wherein the switchback path is connected to the sheet feeder unit.

19. The image forming apparatus according to claim 18, wherein the sheet feeder unit comprises at least one rotating member, wherein the image forming apparatus comprises a movement mechanism configured to cause one of the recording sheets placed on the sheet placement portion and the rotating member to be moved closer to or away from the other one of the rotating member and the recording sheets, and wherein the movement mechanism causes the one of the recording sheets and the rotating member to be moved away from the other of the recording sheets and the rotating member before the recording sheet conveyed along the re-conveyance mechanism is guided into the conveyance path.

20. The image forming apparatus according to claim 19, wherein the at least one rotating member comprises a sheet feed roller configured to contact with an uppermost recording sheet placed on the sheet placement portion and rotate to convey the recording sheet, and a separation roller disposed downstream from the sheet feed roller in the conveyance path, and wherein the movement mechanism is configured to cause one of the recording sheets placed on the sheet placement portion and the sheet feed roller to be moved closer to or away from the other one of the sheet feed roller and the recording sheets.

21. The image forming apparatus according to claim 13, wherein the sheet ejection unit comprises a drive roller, and a driven roller driven to rotate by a driving force of the drive roller, by which the recording sheet is conveyed while being nipped between them, and wherein the drive roller and the driven roller are configured to be movable between a sheet ejection position where the recording sheet passed through the image forming unit is ejected outside the casing and a re-conveyance position where the recording sheet passed through the image forming unit is conveyed toward the re-conveyance mechanism.

22. The image forming apparatus according to claim 13, wherein a switching member configured to be switchable between a sheet ejection posture and a re-conveying posture is provided in the downstream-side path, between the image forming unit and the sheet ejection unit, and the recording sheet passed through the image forming unit is guided toward the sheet ejection unit by the switching member in the sheet ejection posture and guided to the re-conveyance mechanism by the switching member in the re-conveying posture.

23. The image forming apparatus according to claim 13, wherein the conveyance path has a generally C-shaped configuration.

* * * * *